US005449980A

United States Patent [19]

Kiefer et al.

[11] Patent Number: 5,449,980

[45] Date of Patent: Sep. 12, 1995

[54] BOOSTING OF LAMP-DRIVING VOLTAGE DURING HOT RESTRIKE

[75] Inventors: George E. Kiefer; Gary C. Seitz, both of Hendersonville, N.C.

[73] Assignee: General Electric Company, Schenectady, N.Y.

[21] Appl. No.: 306,800

[22] Filed: Sep. 15, 1994

[51] Int. Cl.[6] ..... H05B 37/00

[52] U.S. Cl. ..... 315/240; 315/141; 315/209 CD; 315/DIG. 5

[58] Field of Search ..... 315/209 CD, 209 R, 240, 315/238, DIG. 5, 141, DIG. 7

[56] References Cited

U.S. PATENT DOCUMENTS

| | | | |
|---|---|---|---|
| 3,732,460 | 5/1973 | Wattenbach | 315/240 |
| 4,479,467 | 10/1984 | Burrows et al. | 315/209 SC X |
| 5,367,227 | 11/1994 | Gademann et al. | 315/240 |

*Primary Examiner*—Robert J. Pascal
*Assistant Examiner*—Reginald A. Ratliff
*Attorney, Agent, or Firm*—George E. Hawranko; Stanley C. Corwin

[57] ABSTRACT

Disclosed is a ballast circuit arrangement for a gas discharge lamp, which includes a ballast transformer arrangement receptive of an input power signal, having a winding and a serially connected ballast capacitor, and providing an output, ballast voltage that alternates in polarity during successive half cycles. A bypass capacitor is coupled to the winding of the ballast transformer for being charged by the ballast voltage. A voltage for driving the lamp exists on the bypass capacitor. The inventive arrangement includes a pulse transformer having a secondary winding in serial circuit with the lamp for impressing a high voltage, hot restrike starting pulse across the lamp. A hot restrike starting circuit is provided, comprising a starting capacitor coupled across the bypass capacitor, and a circuit for discharging the starting capacitor including a primary winding of the pulse transformer and a serially connected current switch. A circuit is provided to boost the lamp-driving voltage during operation of the hot restrike circuit, comprising a one-way current valve for substantially shorting out the ballast voltage during at least part of a half cycle of ballast voltage of a first polarity, whereby voltage across the ballast capacitor becomes additive to the voltage across the ballast transformer winding in the next, opposite polarity half cycle of ballast voltage so as to boost the lamp-driving voltage impressed across the lamp during such opposite polarity half cycle. Also included is circuitry for disabling the voltage boost circuit during normal lamp operation.

10 Claims, 4 Drawing Sheets

BOOSTING OF LAMP-DRIVING VOLTAGE DURING HOT RESTRIKE

This application is related to the following, co-pending applications that are commonly owned by the present assignee: "System for Starting a High Intensity Discharge Lamp," Ser. No. 08/506,342 (applicant docket no. LD-10519), filed concurrently herewith; and "Regulation of Hot Restrike Pulse Intensity and Repetition," Ser. No. (applicant docket no. LD 10738), 08/306,869 filed concurrently herewith. The disclosures of the foregoing applications are herein incorporated by reference.

FIELD OF THE INVENTION

The present invention relates to a ballast circuit arrangement including hot restrike circuitry for rapidly restarting a high intensity discharge (HID) lamp after it has recently turned off, and while it is still hot. More particularly, the invention is directed to an improvement for boosting the lamp-driving voltage during the time that the hot restrike circuitry provides one or more hot restrike pulses for initiating lamp re-start.

BACKGROUND OF THE INVENTION

High intensity discharge (HID) lamps are typically used where large areas require illumination, such as in factories, parking lots and sports arenas. In some applications, such as illuminating a sports arena during a sporting event, after a momentary power failure that terminates illumination by the lamps, it is naturally desired that the lamps rapidly restart to allow the sporting event to continue. However, a hot HID lamp typically requires a high current at an elevated voltage to cause the lamp to drop in voltage to where its power supply, or ballast, circuit can sustain lamp operation.

The above cross-referenced application entitled "System for Starting a High Intensity Discharge Lamp," Ser. No. (applicant docket no. LD-10519), is directed to a hot restrike circuit for starting extinguished HID (e.g. metal halide) lamps that are still hot. With such hot restrike circuit, multiple high voltage pulses per half cycle of lamp-driving voltage are provided to assure the high current at an elevated voltage needed to initiate glow-to-arc transition, i.e. , lamp turn-on. Such high voltage pulses are referred to herein as "hot restrike" pulses. The above cross-referenced application entitled "Regulation of Hot Restrike Pulse Intensity and Repetition," Ser. No. (applicant docket no. LD 10738), is directed to further improvements in a hot restrike circuit. One improvement is to regulate the intensity of hot restrike pulses so that they are consistently at a high level. As such, the hot restrike pulses are more effective at delivering the high current to the lamp needed to achieve glow-to-arc transition. Another improvement is to increase the reliability of obtaining multiple hot restrike pulses during a half cycle of lamp-driving voltage, which also contributes to the effectiveness of the hot restrike pulses.

Over the life of a lamp, however, hot restrike capability is prone to degrading. Degrading also typically occurs when a hot restrike circuit is operated in higher temperature ambients, or when the voltage of a power source decreases. Such degrading of hot restrike performance can become so severe that a lamp will fail to achieve glow-to-arc transition, i.e., fail to start. One approach to remedying such degradation would be to modify the hot restrike circuitry to increase the pulse rate and energy in each hot restrike pulse. This approach, however, normally involves using significantly larger components in the hot restrike circuitry (e.g. capacitors), or adding more winding turns to a ballast transformer, which often are impractical. It would, therefore, be desirable to enhance the effectiveness of hot restrike circuitry so that it reliably works even in such extreme conditions, and also without any substantial increase in size of the hot restrike circuitry or the ballast transformer.

SUMMARY OF THE INVENTION

It is, accordingly, an object of the invention to provide, for a gas discharge lamp, a ballast circuit arrangement in which hot restrike performance is made more reliable, even under the above-mentioned, severe conditions.

A further object of the invention is to provide, for a gas discharge lamp, a ballast circuit arrangement wherein the foregoing performance improvement is attained without any substantial increase in the size of hot restrike circuitry or the ballast transformer.

In accordance with a preferred embodiment of the invention, there is provided a ballast circuit arrangement for a gas discharge lamp, which includes a ballast transformer arrangement receptive of an input power signal, having a winding and a serially connected ballast capacitor, and providing an output, ballast voltage that alternates in polarity during successive half cycles. A bypass capacitor is coupled to the winding of the ballast transformer for being charged by the ballast voltage. A voltage for driving the lamp exists on the bypass capacitor. The inventive arrangement includes a pulse transformer having a secondary winding in serial circuit with the lamp for impressing a high voltage, hot restrike starting pulse across the lamp. A hot restrike starting circuit is provided, comprising a starting capacitor coupled across the bypass capacitor, and a circuit for discharging the starting capacitor including a primary winding of the pulse transformer and a serially connected current switch. A circuit is provided to boost the lamp-driving voltage during operation of the hot restrike circuit, comprising a one-way current valve for substantially shorting out the ballast voltage during at least part of a half cycle of ballast voltage of a first polarity, whereby voltage across the ballast capacitor becomes additive to the voltage across the ballast transformer winding in the next, opposite polarity half cycle of ballast voltage so as to boost the lamp-driving voltage impressed across the lamp during such opposite polarity half cycle. Also included is a means for disabling the voltage boost circuit during normal lamp operation.

BRIEF DESCRIPTION OF THE DRAWING FIGURES

The foregoing, and further, objects and advantages of the invention will become apparent from the following description when read in conjunction with the drawing, in which.

Figure 1:
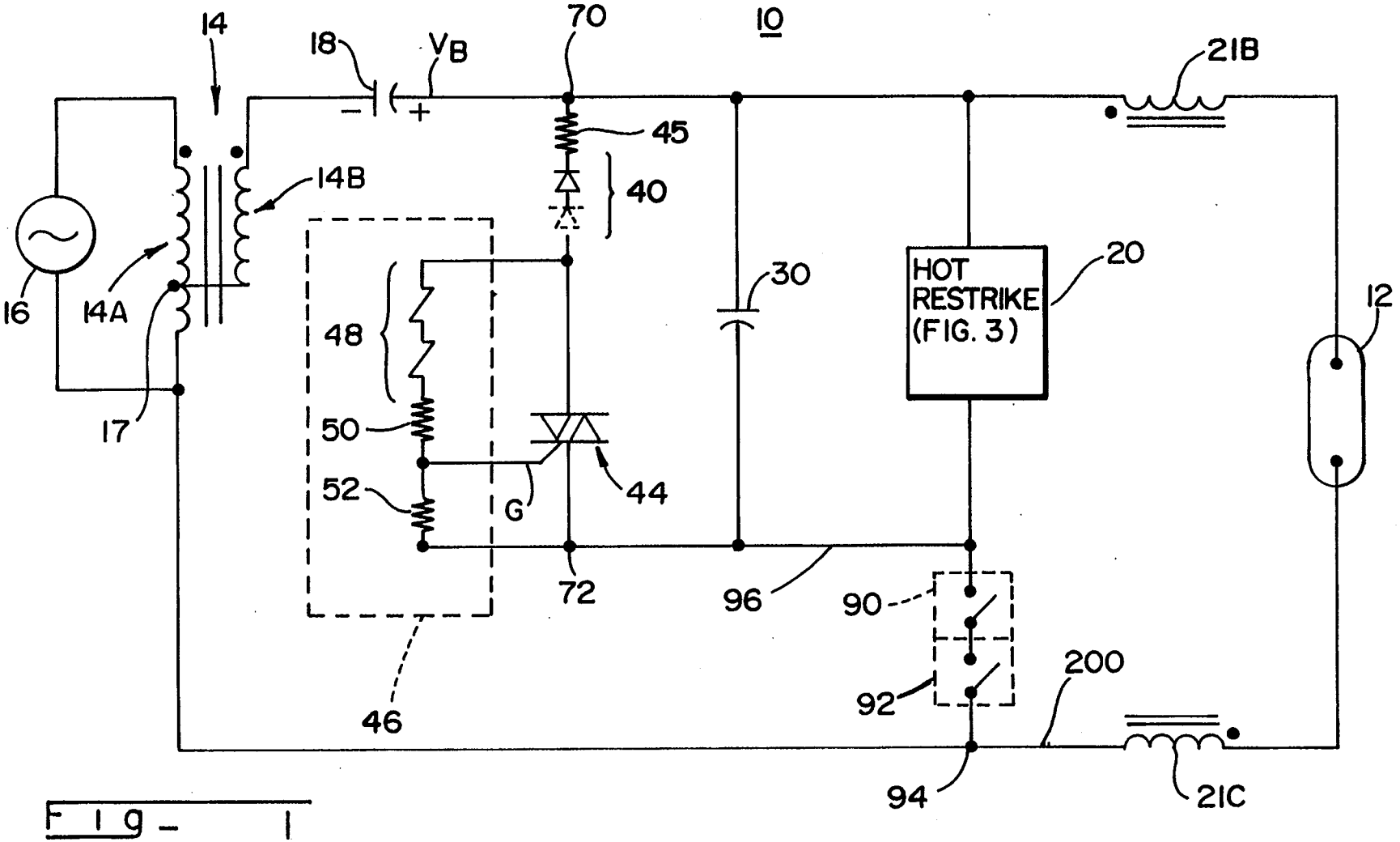
FIG. 1 is a schematic diagram, partially in block form, of a gas discharge lamp ballast circuit arrangement incorporating a hot restrike circuit and a circuit to boost the lamp-driving voltage during operation of the hot restrike circuit, in accordance with the invention.
Figure 5:
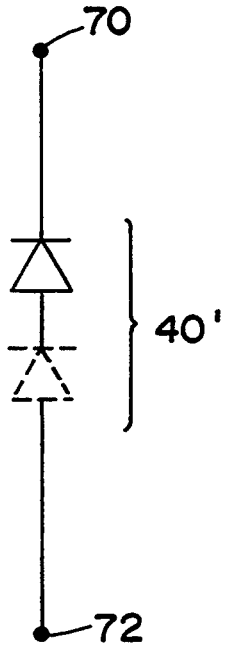

FIG. 5 shows a circuit between nodes 70 and 72 that can replace the circuitry of FIG. 1 between the like-numbered nodes that comprises one-way current valve 40, triac 44, resistor 45 and gate circuitry 46.

DETAILED DESCRIPTION OF THE PREFERRED EMBODIMENTS

FIG. 1 shows a ballast circuit arrangement 10 for powering a high intensity discharge (HID) lamp 12, such as a metal halide lamp. A primary winding 14A of a ballast transformer 14 receives an a.c. power signal from source 16, and produces an output voltage on secondary winding 14B. Transformer 14 is known as a regulating transformer, and has a secondary winding 14B that is tapped into primary winding 14A at 17. Although not shown, transformer 14 could have a secondary winding (14B) isolated from a primary winding (14A). For the purposes of the invention, it is important, however, that a ballast capacitor 18 be serially connected to the to a ballast transformer winding, e.g. 14B. Capacitor 18 need not, however, be positioned as shown in FIG. 1, and could, for instance, be placed between secondary winding 14B and tap 17. In the circuit shown, a ballast capacitor 18 produces a desired phase angle between current and voltage supplied by source 16, and, in combination with ballast transformer 14, limits current to lamp 12. Other suitable types of ballast transformers will be apparent to those of ordinary skill in the art.

A hot restrike circuit 20, shown in block in FIG. 1, produces one or more pulses of current that are received by pulse transformer secondary windings 21B and 21C. During this time, relays 90 and 92 (described below) between a circuit common 94 and conductor 96 are both closed. As a result, respective, additive high voltage (hot restrike) pulses are induced in secondary windings 21B and 21C of such pulse transformer. For a 2000-watt, 250-volt lamp, for instance, the high voltage would likely be in excess of 10 kilovolts for each pulse transformer. The high voltage pulses from windings 21B and 21C are impressed across lamp 12 as "hot restrike" pulses for initiating restarting of the lamp while the lamp is still hot. The use of the two secondary windings 21B and 21C has the advantage of reducing the peak lamp voltage relative to circuit common 94, since the windings create additive, opposite polarity voltages about circuit common 94. Only one secondary winding 21B or 21C could be used if desired, however. Further details of hot restrike circuit 20 are described below in connection with FIG. 3.

A bypass capacitor 30 is coupled to secondary winding 14B of ballast transformer 14 so as to be charged by ballast voltage $V_B$. Bypass capacitor 30 prevents the high voltage, hot restrike pulses from damaging transformer 14.

In accordance with a particular embodiment of the invention, a one-way current valve 40 is coupled to ballast capacitor 18 so as to short out ballast voltage $V_B$ during half cycles when such voltage is normally negative. Alternatively, current valve 40 can be poled in the opposite manner from that shown, whereby valve 40 shorts out ballast voltage $V_B$ during half cycles when such voltage is normally positive. One-way current valve 40 may be implemented as a single p-n diode as shown in solid lines, or with a further p-n diode as shown in phantom lines. However, alternative implementations of one-way current valve 40 will be apparent to those of ordinary skill in the art. In the FIG. 1 circuit, moreover, a triac 44, in serial circuit with one-way current valve 40, is included to disable the one-way current valve once the lamp has started. A resistor 45 in serial circuit with triac 44 protects the triac by limiting surge current from bypass capacitor 30 when one-way current valve 40 first shorts ballast voltage $V_B$ and bypass capacitor 30 discharges.

The conduction state of triac 44 is determined by a control signal on its gate (or control) electrode G. Circuit 46 provides the gate control signal on gate G. It includes a voltage-breakover switch 48, which may comprise one or more serially connected SIDACS as shown, or Zener diodes, by way of example. Also included is a resistor 50 for limiting the current to gate G, and a resistor 52 for providing a bypass path to circuit common 94 for leakage current from triac 44 so that the triac will not turn on during high temperature exposure.

Voltage-breakover switch 48 breaks over when the voltage impressed across it, which is substantially the lamp voltage, exceeds its breakover voltage rating. This occurs before the lamp turns on; after lamp turn-on, the lamp voltage drops considerably. Before lamp turn-on, therefore, switch 48 breaks over when ballast voltage $V_B$ exceeds its breakover rating, and provides a suitable voltage on triac gate G to turn on the triac, thus enabling one-way current valve 40 to short out ballast voltage $V_B$.

After lamp turn on, when the lamp voltage has dropped below the breakover rating of switch 48, such switch, remaining non-conducting, does not provide an appropriate voltage on triac gate G to turn on the triac. In this manner, the triac, and hence, one-way current valve 40, remain disabled.

Figure 2:
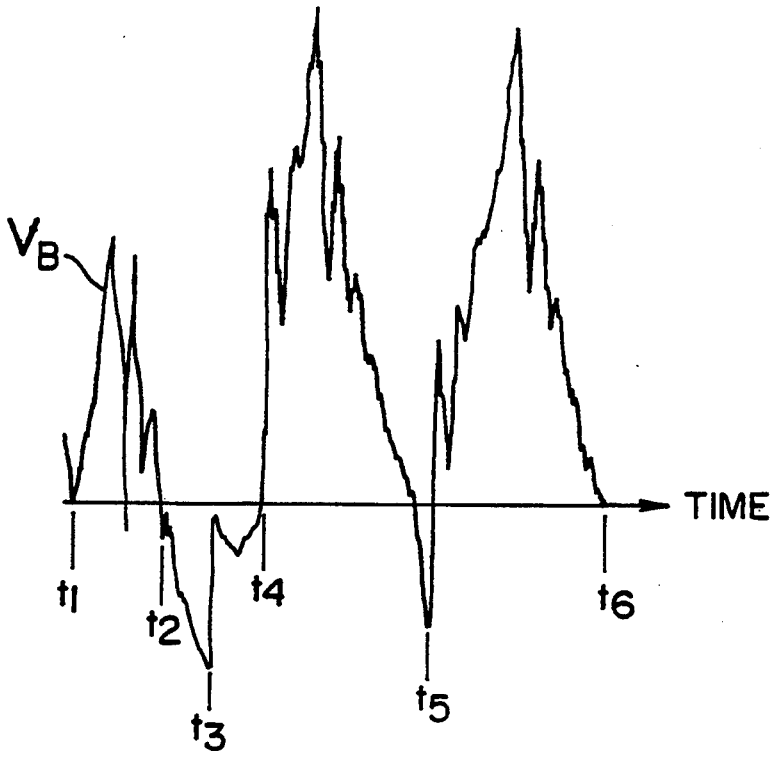
FIG. 2 shows a waveform of ballast voltage $V_B$ for illustrating the operation of one-way current valve 40 and triac 44.

FIG. 2 shows a waveform for ballast voltage $V_B$ for illustrating operation of one-way current valve 40 and triac 44. Such waveform was made with hot restrike circuit 20 implemented, in a preferred, specific example, as described in above-referenced application Serial No. (applicant docket no. LD 10738) with the following changes to the specific example provided in that application, using the reference numerals from that application: Pulse transformer secondary windings 20B and 20C each having 36 turns rather than 48 turns; trigger resistor 62, being 3.3 k ohms rather than 1.0 k ohms; and voltage-breakover switch 63 having a 600-volt breakover voltage rather than a 400-volt breakover voltage. For the purposes of FIG. 2, operation of hot restrike circuit 20 was disabled so that the ballast voltage $V_B$-boosting effect of one-way current valve 40 could be independently shown; such disabling was accomplished by open-circuiting horizontally shown line 60 in present FIG. 3, between pulse transformer primary winding 21A and starting capacitor 22.

Referring to FIG. 2, a positive half cycle of ballast voltage $V_B$ is shown between times $t_1$ and $t_2$. In the absence of one-way current valve 40 and triac 44, the following, negative half cycle of ballast voltage $V_B$ would be repeated, but in the negative direction. However, at time $t_3$, the negative ballast voltage reaches the breakover voltage of switch 48, resulting in triac 44 turning on. With triac 44 on, one-way current valve 40 conducts and shorts out the ballast voltage, although, between times $t_3$ and $t_4$, a relatively small, negative ballast voltage is caused by a resistive voltage drop in resistor 45 arising from current in transformer winding 14B charging ballast capacitor 18.

Due to the foregoing shorting action of valve 40, ballast capacitor 18 becomes charged from current in ballast winding 14B so that it has a positive voltage on its right-hand illustrated side during the next, positive half cycle of ballast voltage. The ballast capacitor voltage has a polarity such that it adds to the voltage generated on ballast winding 14B, creating a substantial d.c. offset in the positive direction indicated in FIG. 2 by the increased peak values of the ballast voltage $V_B$ to the right of time $t_4$. At each of times $t_5$ and $t_6$, triac 44 again turns on, to begin a repetition of the foregoing process of shorting out the ballast voltage $V_B$.

The increased, or boosted, ballast voltage $V_B$ applied across lamp 12 significantly assists by itself in facilitating glow-to-arc transition in the lamp. During operation of the invention, however, hot restrike circuit of FIG. 1 simultaneously causes pulse transformer secondary windings 21B and 21C to generate one or more hot restrike pulses across the lamp, further facilitating glow-to-arc transition of the lamp.

Figure 3:
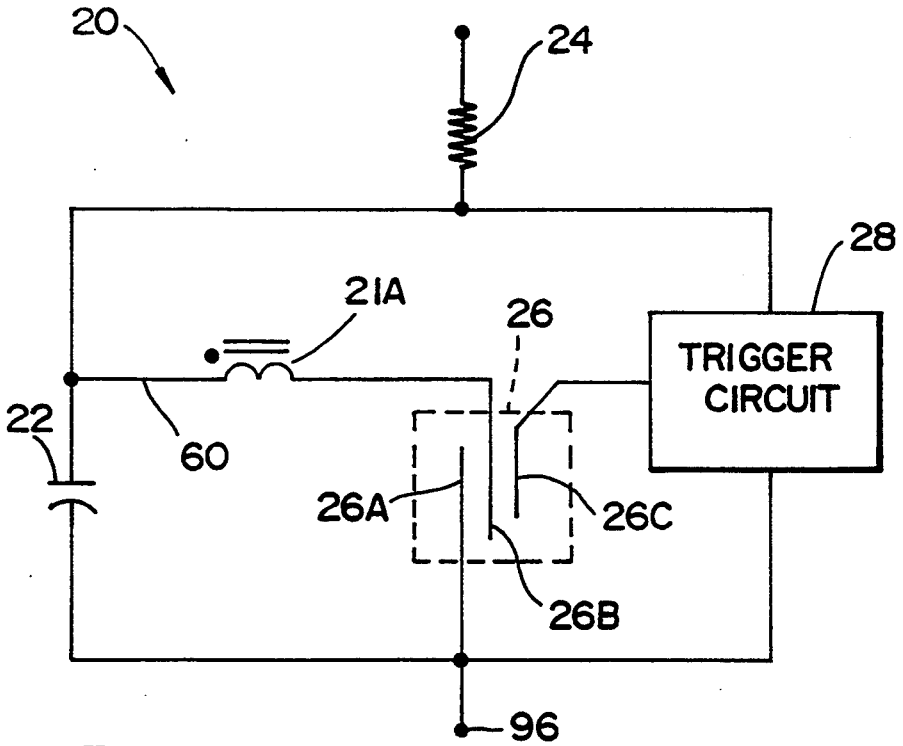
FIG. 3 shows a preferred implementation of hot restrike circuit 20 of FIG. 1.

Referring to FIG. 3, a preferred implementation of hot restrike circuit 20 is illustrated. A starting capacitor 22 is charged from bypass capacitor 30 and ballast capacitor 18 (FIG. 1) by current flowing through a resistor 24. A discharge circuit for capacitor 22 includes primary winding 21A of the above-described pulse transformer for producing hot restrike pulses. Capacitor 22 becomes discharged when a conductive state is established in current switch 26 between its main current-carrying electrodes 26A and 26B. This occurs when control electrode 26C of switch 26 receives an appropriate control signal from trigger circuit 28. With current switch 26 embodied as a three-electrode spark gap device as shown, a pulse of current supplied by trigger circuit 28 causes a spark discharge from control electrode 26C, through main electrode 26B, to main electrode 26A. This makes switch 26 conductive so that capacitor 22 discharges through node 96 to circuit common 94 (FIG. 1) via pulse transformer primary winding 21A.

With current switch 26 embodied as a three-electrode spark gap device, switch electrodes 26A–26C preferably comprise respective, elongated conductive members that are substantially parallel to each other. Further details of such a three-electrode spark gap device are disclosed in the above-referenced application Ser. No. 08/306,342 (applicant docket no. LD-10519). However, other forms of switching devices that switch in response to a control signal on a control electrode are suitably used. For example, switch 26 may be embodied as an SCR, a triac, or a transistor such as a bipolar transistor, or an insulated-gate transistor.

Trigger circuit 28, meanwhile, may be implemented, by way of example, as the trigger circuit disclosed in the above-referenced application Ser. No. 08/306,869 (applicant docket no. LD 10738) as modified by the changes to the specific example provided in the foregoing application mentioned above in connection with FIG. 2. Other implementations of trigger circuit 28 will be routine to those of ordinary skill in the art.

Figure 4:
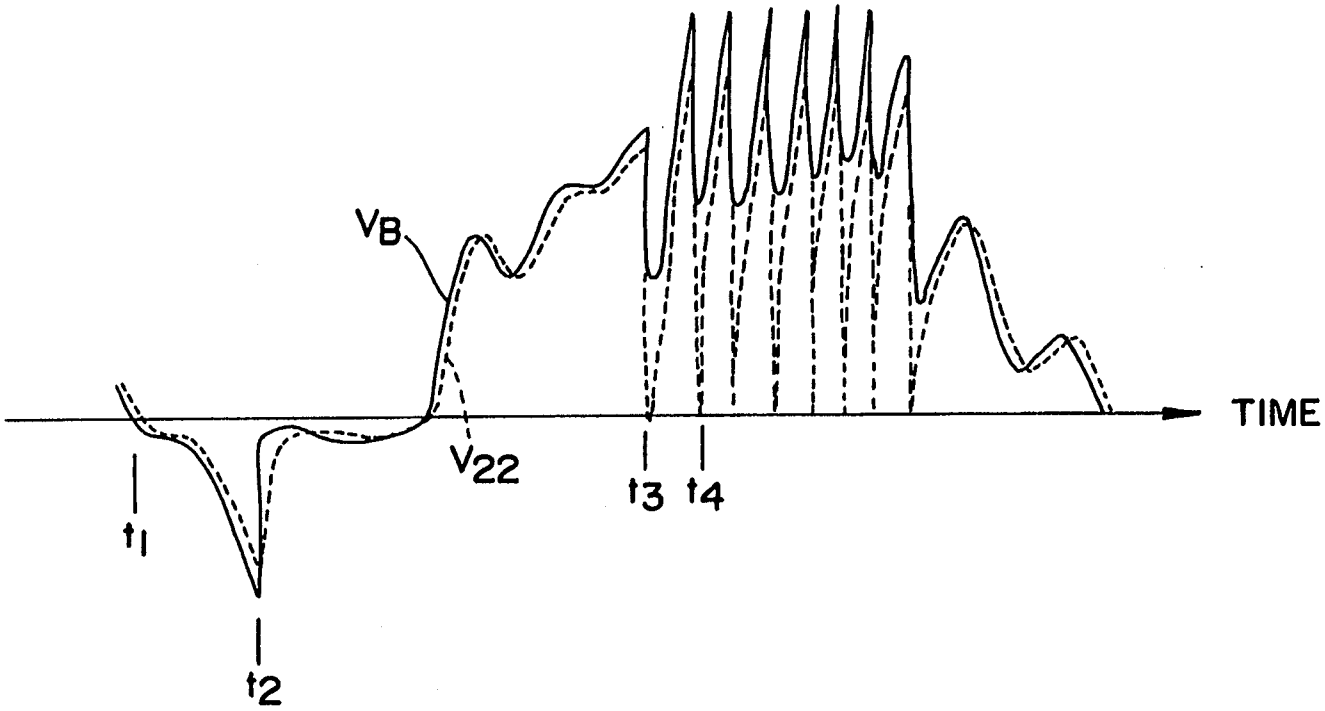
FIG. 4 shows, on an expanded time scale relative to FIG. 2, ballast voltage $V_B$, as well as voltage $V_{22}$ across starting capacitor 22 of FIG. 3.

FIG. 4 shows, on an expanded time scale relative to FIG. 2, ballast voltage $V_B$, as well as voltage $V_{22}$ across starting capacitor 22 (FIG. 3). Referring to FIG. 4, a negative half cycle of ballast voltage starts at time $t_1$. At time $t_2$, the (negative) ballast voltage $V_B$ reaches the breakover voltage of switch 48 (FIG. 1), causing triac 44 to turn on, and one-way current valve 40 to conduct. As mentioned above in connection with FIG. 2, ballast capacitor 18 (FIG. 1) becomes charged, and adds a substantial d.c. offset to ballast voltage $V_B$ in the next, positive half cycle. Due to operation of hot restrike circuitry 20, at time $t_3$, starting capacitor 22 (FIG. 3) discharges through pulse transformer primary winding 21A, causing a hot restrike pulse across secondary windings 21B and 21C (FIG. 1) as described above. Thus, at time $t_3$, voltage $V_{22}$ across capacitor 22 drops steeply.

After recharging, capacitor 22 again is discharged in the foregoing manner at time 14 to create another hot restrike pulse. This process is repeated six more times in the half cycle of ballast voltage shown in FIG. 4. Lamp 12 typically starts, however, within as few as two hot restrike pulses, when lamp-current relay 92 (FIG. 1), which is normally closed, senses current in lamp 12 and opens so as to disable hot restrike circuit 20. Although not shown in FIG. 4, when hot restrike circuit 20 is disabled, the pulsing action shown for instance at times $t_3$ and $t_4$ ceases, and ballast voltage $V_B$ drops to the normal operating voltage of the lamp. Current relay 92 can be implemented, e.g., with a standard current relay whose current-sensing winding (not shown) is placed in conductor line 200 leading to the lamp.

The opening of current relay 92 also disables one-way current valve 40. This disabling action is independent of the above-described disabling of valve 40 that occurs when ballast voltage $V_B$, after the lamp has started, drops too low to cause breakover of voltage-breakover switch 48. This latter disabling action involving switch 48 is not present in an alternative embodiment of the invention wherein one-way current valve 40, triac 44, and associated circuitry in FIG. 1, between nodes 70 and 72, are replaced by the circuit shown in FIG. 5.

Referring to FIG. 5, a one-way current valve 40' is shown, which may be implemented in the same manner as one-way current valve 40 of FIG. 1 as described above, and may also be reversed in polarity. In this alternative embodiment, one-way current valve 40' commences conducting and shorting out ballast voltage $V_B$ quickly after that voltage goes negative, e.g. at about 1.4 volts for dual p-n diodes. In FIG. 2, this occurs shortly after time $t_2$, instead of at time $t_3$ when ballast voltage $V_B$ reaches the breakover voltage of switch 48 (FIG. 1). Once lamp 12 has started, current relay 92 senses lamp current, as described above, and disables one-way current valve 40', usually within one or two half cycles of ballast voltage. Other means of disabling one-way current valve 40', however, may be used in addition or exclusively.

The use of the present inventive technique of boosting ballast voltage $V_B$, and hence the lamp-driving voltage, during a hot restrike process is especially beneficial when using three-electrode spark gap device 26 described above in connection with FIG. 3. This is because the boosting of the ballast voltage $V_B$ also boosts the voltage to which starting capacitor 22 (FIG. 3) of hot restrike circuit 20 is charged, increasing the energy (and effectiveness) of each hot restrike pulse. As a result, the inter-electrode alignment tolerances encountered in manufacturing three-electrode spark gap device 26 are considerably relaxed, whereby device 26 can be made at a substantially reduced cost.

The increase in energy of each restrike pulse, resulting from the present invention, also relaxes the design criteria for hot restrike circuits in general. For instance, the above-mentioned specific example mentions a reduction from 48 to 36 in the number of winding turns on the pulse transformer secondary windings.

Referring again to FIG. 1, timer relay 90, which is normally open, is responsive to a.c. line voltage, e.g. from power source 16. When power is first supplied to the ballast circuit arrangement 10 of FIG. 1, a first timer function causes relay 90 to close and then to subject the hot restrike circuitry to a duty cycle of about 1:10 so as to minimize stresses on such circuitry. For instance, relay 90 may close within about 50 milliseconds of a.c. power being applied, and, to complete a duty cycle, remain closed for about 200 milliseconds, and open for about 2 seconds. If the lamp has not started within, for instance, 20 of the mentioned duty cycles, a second timer function opens the relay to shut off power to the hot restrike circuitry; it is also desired at this time that power to the circuitry (not shown) implementing the foregoing timer functions be shut off in such a manner that the timer resets. Implementing timer relay 90 will be routine to those of ordinary skill in the art based on the present specification.

In a comprehensive example of implementing the ballast circuit arrangement of FIGS. 1 and 3, the component values for a 250-volt, 2000-watt metal halide lamp may be as indicated in the specific example above in connection with FIG. 2. In this example, polarities of transformer windings are indicated by dots in FIGS. 1 and 3. Further, resistors 45, 50 and 52 (FIG. 1) respectively are 10 ohms, 3.3 k ohms, and 1 k ohms; and voltage-breakover switch 48 comprises one or more serially connected SIDACS having a total breakover voltage of about 720 volts, such as available under Part No. KIV24 from Shidengen Electric Mfg. Co. Ltd. of Tokyo, Japan.

From the foregoing, it will appreciated that the invention provides, for a gas discharge lamp, a ballast circuit arrangement having a hot restrike capability, in which hot restrike performance is made more reliable, even under the severe conditions of lamp aging, operation in higher temperature ambients, or decreases of power source voltage. Additionally, the design criteria for hot restrike circuits in general are relaxed. These benefits, moreover, are achieved without any substantial increase in the size of hot restrike circuitry or the ballast transformer.

While the invention has been described with respect to specific embodiments by way of illustration, many modifications and changes will occur to those skilled in the art. It is, therefore, to be understood that the appended claims are intended to cover all such modifications and changes as fall within the true scope and spirit of the invention.

What is claimed is:

1. A ballast circuit arrangement for a gas discharge lamp, comprising:

(a) a ballast transformer arrangement receptive of an input power signal, including a winding and a serially connected ballast capacitor, and providing an output, ballast voltage that alternates in polarity during successive half cycles;

(b) a bypass capacitor coupled to said winding of said ballast transformer for being charged by the ballast voltage, and on which a voltage for driving the lamp exists;

(c) a pulse transformer having a secondary winding in serial circuit with the lamp for impressing a high voltage, hot restrike starting pulse across the lamp;

(d) a hot restrike starting circuit comprising a starting capacitor coupled across said bypass capacitor, and a circuit for discharging said starting capacitor including a primary winding of said pulse transformer and a serially connected current switch;

(e) a circuit to boost the lamp-driving voltage during operation of said hot restrike circuit, comprising a one-way current valve for substantially shorting out the ballast voltage during at least part of a half cycle of ballast voltage of a first polarity, whereby voltage across said ballast capacitor becomes additive to the voltage across said ballast transformer winding in the next, opposite polarity half cycle of ballast voltage so as to boost the lamp-driving voltage impressed across the lamp during said opposite polarity half cycle; and (f) means for disabling said voltage boost circuit during normal lamp operation.

2. The ballast circuit arrangement of claim 1, wherein said disabling means comprises a current switch responsive to lamp current for decoupling said voltage boost circuit from the ballast voltage when current in the lamp exceeds a predetermined value.

3. The ballast circuit arrangement of claim 1, wherein said means for disabling said voltage boost circuit comprises means to prevent conduction of said one-way current valve during said half cycle of ballast voltage of first polarity so long as the ballast voltage is at a level for normal lamp operation.

4. The ballast circuit arrangement of claim 3, wherein said disabling means additionally comprises a current switch responsive to lamp current for decoupling said voltage boost circuit from the ballast voltage when current in the lamp exceeds a predetermined value.

5. The ballast circuit arrangement of claim 3, wherein said means to prevent conduction comprises:

(a) a current switch in serial circuit with said one-way current valve and having a conduction state determined by a control signal received on a control electrode; and (b) a circuit for providing said control signal comprising a voltage-breakover switch across which is impressed a switch voltage at substantially the level of voltage across the lamp, and a responsive circuit for creating said control signal when said switch voltage exceeds a threshold level.

6. A ballast circuit arrangement for a gas discharge lamp, comprising:

(a) a ballast transformer arrangement receptive of an input power signal, including a winding and a serially connected ballast capacitor, and providing an output, ballast voltage that alternates in polarity during successive half cycles;

(b) a bypass capacitor coupled to said winding of said ballast transformer for being charged by the ballast voltage, and on which a voltage for driving the lamp exists;

(c) a pulse transformer having a secondary winding in serial circuit with the lamp for impressing a high voltage, hot restrike starting pulse across the lamp;

(d) a hot restrike starting circuit comprising a starting capacitor coupled across said bypass capacitor, and a circuit for discharging said starting capacitor including a primary winding of said pulse transformer and a serially connected current switch; said current switch comprising a three-electrode spark gap device having a main spark gap formed between a pair of main electrodes, and a triggering spark gap formed between one of the main electrodes and a trigger electrode that is responsive to a control signal;

(e) a circuit to boost the lamp-driving voltage during operation of said hot restrike circuit, comprising a one-way current valve for substantially shorting out the ballast voltage during at least part of a half cycle of ballast voltage of a first polarity, whereby voltage across said ballast capacitor becomes additive to the voltage across said ballast transformer winding in the next, opposite polarity half cycle of ballast voltage so as to boost the lamp-driving voltage impressed across the lamp during said opposite polarity half cycle; and (f) means for disabling said voltage boost circuit during normal lamp operation.

7. The ballast circuit arrangement of claim 6, wherein said disabling means comprises a current switch responsive to lamp current for decoupling said voltage boost circuit from the ballast voltage when current in the lamp exceeds a predetermined value.

8. The ballast circuit arrangement of claim 6, wherein said means for disabling said voltage boost circuit comprises means to prevent conduction of said one-way current valve during said half cycle of ballast voltage of first polarity so long as the ballast voltage is at a level for normal lamp operation.

9. The ballast circuit arrangement of claim 8, wherein said disabling means additionally comprises a current switch responsive to lamp current for decoupling said voltage boost circuit from the ballast voltage when current in the lamp exceeds a predetermined value.

10. The ballast circuit arrangement of claim 8, wherein said means to prevent conduction comprises:

(a) a current switch in serial circuit with said one-way current valve and having a conduction state determined by a control signal received on a control electrode; and (b) a circuit for providing said control signal comprising a voltage-breakover switch across which is impressed a switch voltage at substantially the level of voltage across the lamp, and a responsive circuit for creating said control signal when said switch voltage exceeds a threshold level.

* * * * *